United States Patent [19]

Heng

[11] Patent Number: 4,657,148

[45] Date of Patent: Apr. 14, 1987

[54] SLIDABLY STAGGERABLE TIERED DOCUMENT TRAY

[75] Inventor: Cheng K. Heng, Kechil, Singapore

[73] Assignee: Metro Plastic Industry Pte. Ltd., Kallang Place, Singapore

[21] Appl. No.: 781,691

[22] Filed: Sep. 30, 1985

[51] Int. Cl.[4] ..... A47F 3/14

[52] U.S. Cl. ..... 211/128; 211/194; D19/92

[58] Field of Search ..... 211/128, 126, 194, 10, 211/11; 220/23.6; 229/DIG. 11; 206/821, 555; D19/92

[56] References Cited

U.S. PATENT DOCUMENTS

| | | | |
|---|---|---|---|
| D. 144,450 | 4/1946 | Cohen | D19/92 |
| D. 180,895 | 9/1957 | Davis | D19/92 |
| D. 220,702 | 5/1971 | Sweet | D19/92 |
| D. 229,108 | 11/1973 | Grosse | D19/92 |
| D. 230,646 | 3/1974 | Unger | D19/92 |
| D. 261,904 | 11/1981 | Polhemus | D19/92 |
| D. 266,772 | 11/1982 | Sayers | D19/92 |
| 3,028,975 | 4/1962 | Bullock | 211/126 |
| 3,154,197 | 10/1964 | Tweed | 211/126 |
| 3,482,708 | 12/1969 | Levit | 211/126 |
| 3,524,553 | 8/1970 | Zitmore . | |
| 3,648,849 | 3/1972 | Harris et al. | 211/126 |
| 4,074,810 | 2/1978 | Juergens | 211/11 |
| 4,253,402 | 3/1981 | Carrig et al. | 211/126 X |
| 4,534,475 | 8/1985 | Mayo | 211/126 |

FOREIGN PATENT DOCUMENTS 1258372 7/1961 France .

*Primary Examiner*—Reinaldo P. Machado
*Assistant Examiner*—Sarah A. Lechok Eley
*Attorney, Agent, or Firm*—Lee W. Tower

[57] ABSTRACT

A slidably staggerable tiered document tray has upper and lower trays with feet. A pair of risers slidably mounted on the side walls of the lower tray provides vertical separation between the upper and lower trays. The risers are designed with ledges upon which the upper tray rests and the feet on the upper tray extend through holes in these ledges and thereby couple the upper tray to the risers. The risers are held on the lower tray with interlaced inner bottom tabs and outer bottom tabs having an alternating inner bottom tab and outer bottom tab arrangement along the length of the risers that slidably attach over the side walls of the lower tray. The upper tray is held on the riser ledges by a combination of the operation of the upper tray feet loosely coupling with the holes in the ledges and tabs on the risers that are in contact with the outside of the upper tray side walls.

17 Claims, 5 Drawing Figures

SLIDABLY STAGGERABLE TIERED DOCUMENT TRAY

BACKGROUND OF THE INVENTION

1. Field of the Invention

This invention relates generally to the document tray art and more particularly to tiered or stacked document trays.

2. Prior Art

The prior art discloses a number of methods of stacking document trays. One method is described in U.S. Pat. No. 4,074,810 to Juergens. Juergens discloses a tiered plastic letter tray which includes a riser plate member which is slidably received into fixed slots on the lower and upper portions of the upper and lower tray respectively. U.S. Pat. Nos. 3,482,708, Des. 180,895, Des. 144,450, Des. 266,772 and Des. 261,904 to Levit, Davis, Cohen, Sayers, and Polhemus, respectively, also disclose stackable trays which include riser plates between the stacked trays. These riser plates fit into certain slots or brackets on the trays, so a disadvantage of all of these designs is that the trays cannot be slid into a staggered arrangement.

U.S. Pat. No. 3,524,553to Zitmore discloses a desk tray which can be stacked and slid into a staggered position. However, Zitmore design effectively has no vertical riser resulting in trays that are vertically very closely spaced, which is a disadvantage when trying to access documents from the lower tray.

A disadvantage of some of the trays of the prior art is that normal feet on the bottom of the tray are either redundant on the upper tray or are very unattractive on the upper tray. Thus, the feet are either left off the bottom of the upper trays, which results in different upper and lower trays, or just appear to be unnecessary appendages on the upper tray.

SUMMARY OF THE INVENTION

The slidable staggerable tiered document tray of the present invention consists of document trays that have therefore a bottom wall, left and a right side walls, whose lower edges are contiguous and flush with the bottom wall, a back wall and a front wall with an opening. Each of the trays has four feet intergrally molded onto the corners of the outside of the bottom wall. Together, a single riser slidably mounted on the left side wall of a lower tray and a single riser slidably mounted on the right side wall of a lower tray provide vertical separation between an upper tray and a lower tray and support for the upper tray. The generally round risers are designed with ledges upon which the upper tray rests. The feet on the upper tray extend through holes, large enough to accept the feet, in these ledges. Thereby the upper tray is loosely coupled to the riser so that when the upper tray is slid back to a staggered position, the riser slides back on the side walls of the lower tray. Each riser is held on the lower tray with interlaced inner bottom tabs and outer bottom tabs arranged along the length of the riser that alternately slidably attach over the inside and outside of the side walls of the lower tray. The upper tray is prevented from being knocked off the riser ledges by a combination of the operation of the upper tray feet loosely coupling with the holes in the riser ledges and a single tab extending upward from each riser to provide a fence on the left and right of the upper tray side walls.

The net effect of this invention is a very attractive and utilitarian design. The feet in this invention are not left dangling on the upper tray without a logical use as in prior art stackable trays. The appearance of the trays is very attractive whether the trays are used separately or in a tiered arrangement.

The trays are slidably staggerable in any degree desired and there is no limit to the number of trays that can be staggered. Since the trays are not fastened together with brackets as in some trays of the prior art, the trays can be easily taken apart for whatever reason such as cleaning or moving.

DESCRIPTION OF THE PREFERRED EMBODIMENTS

Figure 1:
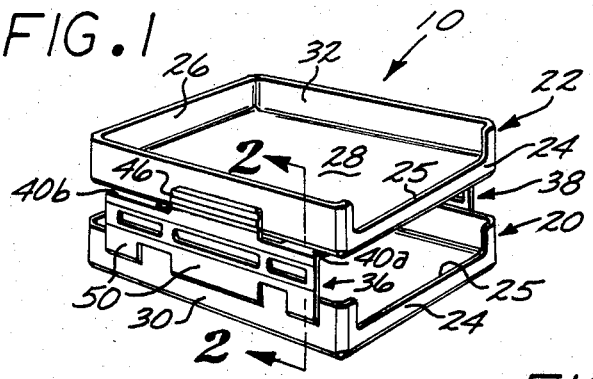
FIG. 1 is a perspective view of the preferred embodiment of the slidably staggerable tiered document tray.
Figure 2:
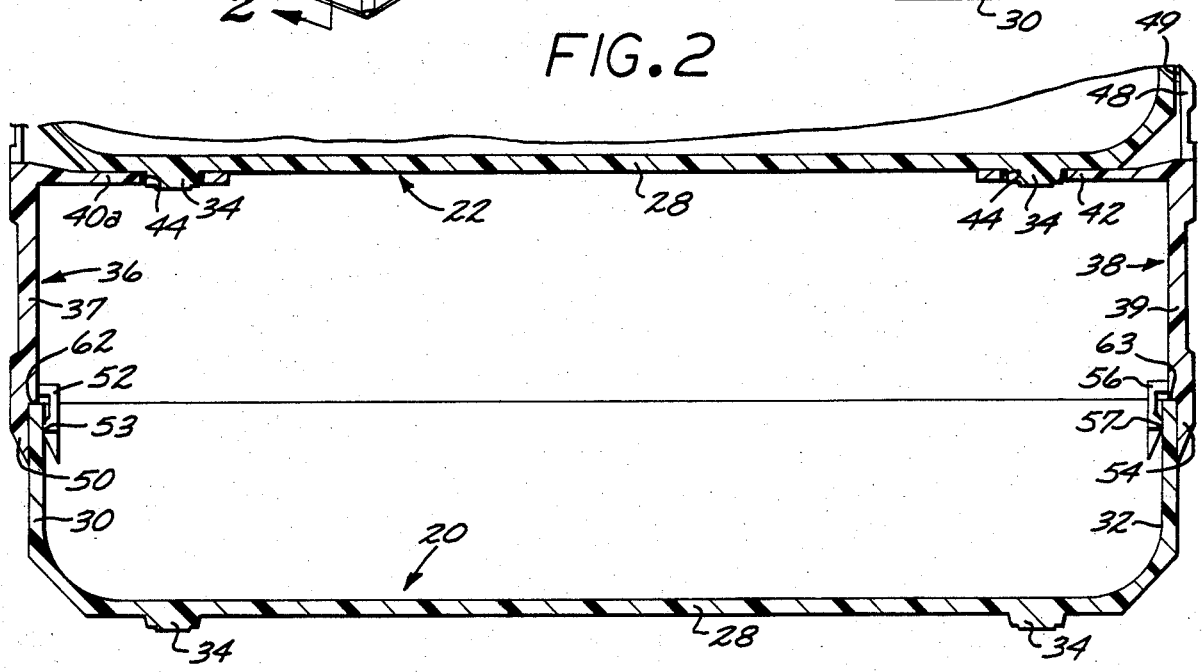
FIG. 2 is a front elevational sectional view along the line 2—2 on FIG. 1.

Referring now to the drawings, and more particularly, to FIG. 1, there is shown a slidably staggerable tiered document tray generally designated 10, which comprises the preferred embodiment of the present invention. The slidably staggerable tiered document tray 10 basically includes a lower document tray 20, an upper document tray 22, left riser 36, and right riser 38. The upper tray 22 is supprted by the risers 36 and 38, which are slidably mounted on the lower document tray 20. The document trays each have a front wall 24 having an opening 25, a back wall 26, a bottom wall 28, a left side wall 30, and a right side wall 32. As shown in FIG. 2, the lower edges of the left side wall 30 and the right side wall 32 are contiguous and flush with the bottom wall 28. The lower edges of the front wall 24 and rear wall 26 are also contiguous and flush with the bottom wall 28, as shown in FIGS. 1, 3, and 4.

Figure 3:
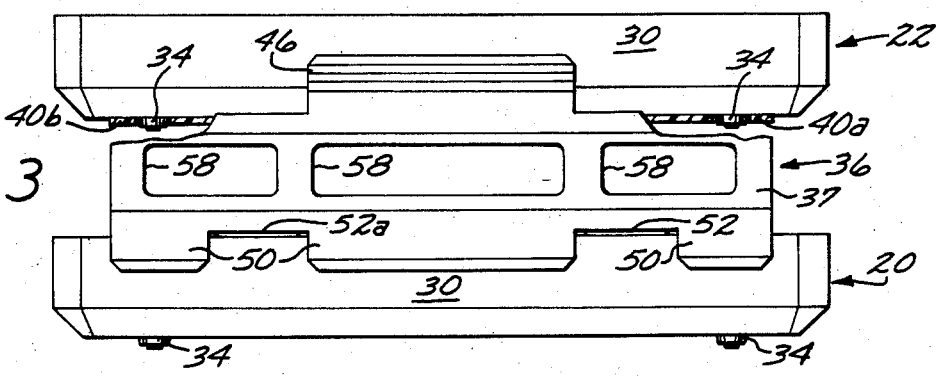
FIG. 3 is a left side elevational view of the slidably staggerable tiered document tray of FIG. 1. A section of FIG. 3 is cutaway to show how the feet of the upper tray couple with the support ledge of the riser.
Figure 4:
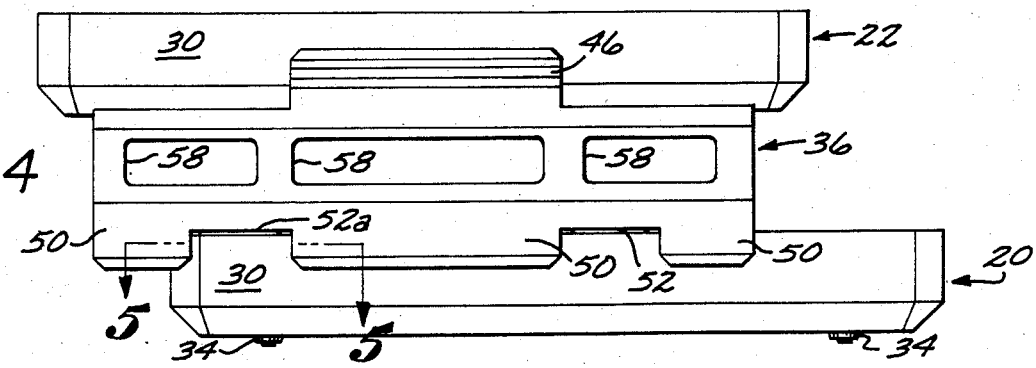
FIG. 4 is a left side elevational view of the slidably staggerable tiered document tray of FIG. 1 showing the upper tray and the riser slid back in a staggered position relative to the bottom tray.

Referring now to FIGS. 1, 2 and 3, the left riser 36 is shown to comprise left support ledges 40, designated 40*a* and 40*b* each having a hole 44, a left vertical spacer section 37, left top tab 46, left bottom outer tabs 50 and left bottom inner tabs 52 with the rearward left bottom inner tab designated 52*a*. Similarly, the right riser 38 comprises right support ledges 42 each having a hole 44, a right vertical spacer section 39, a right top tab 48, right bottom outer tabs 54, and right bottom inner tabs 56. The left and right vertical spacer sections 37 and 39 respectively, provide vertical separation between the upper and lower document trays. As shown in FIGS. 1 and 3 the risers have openings 58 in them. Each of the risers are designed as single integrally molded units. This simplifies the manufacture of the stackable trays and reduces the number of components.

Referring to FIG. 2, the left and right risers, 36 and 38 respectively, are seen to rest on the upper edges, 62 and 63 respectively, of the side walls of the lower tray. The left and right bottom outer tabs, 50 and 54, are slidably attached over the outside of the bottom tray left and right side walls, 30 and 32, respectively. Also, as shown in FIG. 2, the left and right bottom inner tabs, 52 and 56, are slidably attached over the inside of the bottom tray left and right side walls, 30 and 32, respectively. The risers have multiple left and right bottom inner and outer tabs, as shown in FIG. 3. As shown in FIG. 2, the left and right bottom inner tabs, 52 and 56 respectively, make contact with the inner left and right side walls, 30 and 32 respectively, only along the edges 53 and 57 respectively. This latter feature reduces the contact area along the side wall to riser interface and thereby reduces friction when the riser is slid back and forth along the side wall. This also provides a mechanism for providing tension between the bottom inner tabs and the bottom outer tabs. The thin portion of the bottom inner tabs 56 and 52 is slightly bent when engaged over the side walls of the bottom tray; thus, providing tension between the inner bottom tabs and the outer bottom tabs on the side wall of the bottom tray. As shown in FIGS. 1, 3, and 4 the inner and outer bottom tabs are interlaced along the length of the risers, so that, on the left riser proceeding from the front to the rear, the interlaced order of the tabs is outer bottom tab 50, inner bottom tab 52, outer bottom tab 50, inner bottom tab 52*a*, and outer bottom tab 50. Interlacing the tabs provides additional support for holding the risers on the side walls of the lower tray.

FIG. 2 shows the integrally molded feet 34 on the bottom wall of the lower and upper trays. When trays are stacked, the integrally molded feet 34 of the upper tray loosely couple with holes 44 in the left and right support ledges 40 and 42. This is also shown in the cutaway view of FIG. 3. The feet on the bottom wall of the trays are generally round, although any other shape is possible. The holes in the support ledges of the risers are positioned so that when the upper tray is placed on the risers, the feet will extend through the holes on the support ledges. The embodiment described here and shown in the drawings has four feet on the bottom of each tray nominally positioned near the corners of the tray bottom wall. In the preferred embodiment, two feet extend through holes in the left support ledge 40 and two feet extend through holes in the right support ledge 42. As shown in FIG. 1, the left support ledge 40 is not necessarily continuous along the length of the left riser 36. In FIG. 1 it is shown that the left support ledge 40 can be built in a forward and a rear section, designated as 40*a* and 40*b*. Each section 40*a* and 40*b* has one hole 44 to accommodate one of the feet 34. The extension of the feet through these holes loosely couples the upper tray and the risers. The feet are not fastened in any way to the holes in the riser support ledges. Rather, the extension of the feet through the holes is meant to position the upper tray onto the risers. The coupling of the feet with these holes interlocks the upper tray and the risers.

The upper tray 22 is also held on the risers by the operation of the left and right top tabs 46 and 48, respectively. Again, to provide some tension on the contact between the top tabs 46 and 48 and the side walls of the upper tray, the top tabs only make contact with the upper tray along an edge 49, as shown in FIG. 2.

The left and right top tabs prevent an upper tray from falling off the risers either in the leftward or in the rightward direction; however, when the upper tray is being slid forward or backward, only the loose coupling between the feet on the document tray and the holes in the support ledges of the risers prevents the upper tray from sliding backward or forward off the risers. This functional use of the feet on the bottom of the upper tray is also aesthetic, because the feet on the upper tray are not left dangling unused as in some tiered trays in the prior art. The loose coupling between the feet and the holes on the riser is also the only method of coupling the upper tray and the left and right risers together as a unit; thus, when the upper tray is slid back, the left and right risers also slide back together due to the force transmitted to them through the coupling of the upper tray feet and the holes in the riser support ledges.

Figure 5:
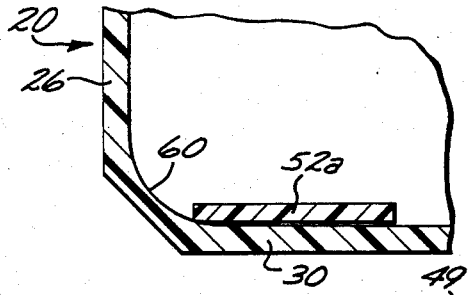
FIG. 5 is a top elevational sectional view along the line 5—5 of FIG. 4 showing how a tab on a riser meets the curved intersection of the side and back walls to prevent the riser and top tray from sliding back too far.

FIG. 4 shows the upper document tray 22 in a staggered back position. The riser 36 can be seen to have slid back an equal amount with the document tray. Of course, riser 38, which is hidden in FIG. 4, also has slid back an equal amount. There is a limit to the distance that the upper tray can be slid back. The limit is reached when one of the bottom inner tabs 52, namely the most rearward bottom inner tab, designated 52*a* in FIG. 4 reaches the intersection of the tray side wall 30 and the tray back wall 26. This is more clearly illustrated in FIG. 5, a top elevational sectional view along the line 5—5 of FIG. 4. As shown in FIG. 5, the intersection 60 of the back wall 26 and the side wall 30 is curved. When the upper tray is slid back and the rearward bottom inner tab 52*a*, and a similar bottom inner tab on the right riser, make contact with the curved intersection 60 of the back and side walls of the bottom tray, the upper tray is prevented from being slid back further. The upper tray is prevented in a similar fashion from being slid forward too far. As shown in FIG. 4, the center of gravity of the upper tray is still well over the bottom tray even when staggered all the way back. This keeps the trays stable when filled with documents.

The design of the trays makes them quite attractive when used alone in a nonstacked fashion. The embodiment described only shows two stacked trays; however, by using additional risers and trays, there is no limit to the number of trays that can be stacked.

It is thought that the slidably staggerable tiered document tray of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A slidably staggerable tiered document tray that includes at least two trays, an upper tray and a lower tray, each having a bottom wall, a back wall, left and right side walls, and a plurality of feet attached to the bottom wall, and a pair of risers, a left riser and a right riser vertically separating each upper and lower tray and having lengths approximately equal to the length of said left and right side walls, detachably engaged between each upper tray and lower tray to provide vertical separation between said trays wherein the improvement comprises:

(a) a left support ledge attached at a right angle to each said left riser and having at least one hole and supporting said upper tray with at least one of said feet on said bottom wall of said upper tray extending through at least one of said holes in said left support ledge for providing a means for loosely coupling said left riser and said upper tray; and (b) a right support ledge attached at a right angle to each said right riser and having at least one hole and supporting said upper tray with at least one of said feet on said bottom wall of said upper tray extending through at least one of said holes in said right support ledge for providing a means for loosely coupling said right riser and said upper tray; and (c) a left top tab attached to each said left riser and in detached contact with the outside of said left side wall of said upper tray; and (d) a right top tab attached to each said right riser and in detached contact with the outside of said right side wall of said upper tray; and (e) a plurality of interlaced inner bottom tabs and outer bottom tabs attached to each said left riser and having an alternating inner bottom tab and outer bottom tab arrangement along the length of said left riser and detachably and slidably engaged over the left side wall of said lower tray, whereby said outer bottom tabs are attached over the outside of said left side wall of said lower tray and said inner bottom tabs are attached over the inside of said left side wall of said lower tray, and wherein said left riser and said upper tray can be slid back towards the back wall of said lower tray so that said upper and lower trays can be staggered; and (f) a plurality of interlaced inner bottom tabs and outer bottom tabs attached to each said right riser and having an alternating inner bottom tab and outer bottom tab arrangement along the length of said right riser and detachably and slidably engaged over the right side wall of said lower tray, whereby said outer bottom tabs are attached over the outside of said right side wall of said lower tray and said inner bottom tabs are attached over the inside of said right side wall of said lower tray, and wherein said right riser and said upper tray can be slid back towards the back wall of said lower tray so that said upper and lower trays can be staggered.

2. A slidably staggerable tiered document tray comprising:

(a) at least two trays, an upper tray and a lower tray, each having a bottom wall, left and a right side walls, a back wall and a front wall having an opening; and (b) at least four feet attached to the outside of the bottom wall of each of said trays wherein said first foot is located nearby the intersection of the front wall, the left side wall and the bottom wall, and said second foot is located nearby the intersection of the back wall, the left side wall and the bottom wall, and said third foot is located nearby the intersection of the front wall, the right side wall and the bottom wall, and said fourth foot is located nearby the intersection of the back wall, the right side wall and the bottom wall; and (c) two risers for supporting said upper tray on said lower tray and for providing vertical separation between said upper and lower trays and having lengths approximately equal to the length of said left and right side walls, wherein said first riser has a vertical spacer section, interlaced inner bottom tabs and outer bottom tabs attached to said vertical spacer section and having an alternating inner bottom tab and outer bottom tab arrangement along the length of said first riser and detachably and slidably engaged over the left side wall of said lower tray, whereby said outer bottom tabs are attached over the outside of said left side wall of said lower tray and said inner bottom tabs are attached over the inside of said left side wall of said lower tray, a forward support ledge attached normal to said vertical spacer section and having a first hole and supporting said upper tray with said first foot extending through said first hole, a back support ledge attached normal to said vertical spacer section and having a second hole and supporting said upper tray with said second foot extending through said second hole, and a top tab attached to said vertical spacer section and in detached contact with the outside of the left wall of said upper tray for providing lateral retention for said upper tray, and wherein said second riser has a vertical spacer section, interlaced inner bottom tabs and outer bottom tabs attached to said vertical spacer section and having an alternating inner bottom tab and outer bottom tab arrangement along the length of said second riser and detachably and slidably engaged over the right side wall of said lower tray, whereby said outer bottom tabs are attached over the outside of said right side wall of said lower tray and said inner bottom tabs are attached over the inside of said right side wall of said lower tray, a forward support ledge attached normal to said vertical spacer section and having a third hole and supporting said upper tray with said third foot extending through said third hole, a back support ledge attached normal to said vertical spacer section and having a fourth hole and supporting said upper tray with said fourth foot extending through said fourth hole, and a top tab attached to said vertical spacer section and in detached contact with the outside of the right wall of said upper tray for providing lateral retention for said upper tray.

3. A slidably staggerable tiered document tray comprising:

(a) a first tray including an essentially rectangular planar bottom wall, an upward extending right side wall whose lower edge is contiguous and flush with said bottom wall and attached to the right edge of said bottom wall, an upward extending left side wall whose lower edge is contiguous and flush with said bottom wall and attached to the left edge of said bottom wall, an upward extending rear wall whose lower edge is contiguous and flush with said bottom wall and attached to the rear edge of said bottom wall, an upward extending front wall whose lower edge is contiguous and flush with said bottom wall and attached to said the front edge of said bottom wall and which has an opening, a first foot integrally molded onto the bottom left front corner of said planar rectangular bottom wall, a second foot integrally molded onto the bottom left rear corner of said planar rectangular bottom wall, a third foot integrally molded onto the bottom right front corner of said planar rectangular bottom wall, and a fourth foot integrally molded onto the bottom right rear corner of said planar rectangular bottom wall; and (b) a second tray including an essentially rectangular planar bottom wall, an upward extending right side wall whose lower edge is contiguous and flush with said bottom wall and attached to the right edge of said bottom wall, an upward extending left side wall whose lower edge is contiguous and flush with said bottom wall and attached to the left edge of said bottom wall, an upward extending rear wall whose lower edge is contiguous and flush with said bottom wall and attached to the rear edge of said bottom wall, an upward extending front wall whose lower edge is contiguous and flush with said bottom wall and attached to said the front edge of said bottom wall and which has an opening, a first foot integrally molded onto the bottom left front corner of said planar rectangular bottom wall, a second foot integrally molded onto the bottom left rear corner of said planar rectangular bottom wall, a third foot integrally molded onto the bottom right front corner of said planar rectangular bottom wall, and a fourth foot integrally molded onto the bottom right rear corner of said planar rectangular bottom wall; and (c) a left riser having a length less than but approximately equal to the length of said left wall of said first tray and having a vertical spacer section for providing a vertical space between said first tray and said second tray, a plurality of inner bottom tabs and outer bottom tabs attached to said vertical spacer section and detachably and slidably engaged over said left wall of said first tray so that said inner bottom tabs are attached over the inside of said left wall and said outer bottom tabs are attached over the outside of said left wall, a forward support ledge attached normal to said vertical spacer section and having a first hole and supporting said second tray with said first foot in said left front corner of said second tray extending through said first hole in said forward support ledge, and a rear support ledge attached normal to said vertical spacer section and having a second hole and supporting said second tray with said second foot in said left rear corner of said second tray extending through said second hole in said forward support ledge; and (d) a right riser having a length less than but approximately equal to the length of said right wall of said first tray and having a vertical spacer section for providing a vertical space between said first tray and said second tray, a plurality of inner bottom tabs and outer bottom tabs attached to said vertical spacer section and detachably and slidably engaged over said right wall of said first tray so that said inner bottom tabs are attached over the inside of said right wall and said outer bottom tabs are attached over the outside of said right wall, a forward support ledge attached normal to said vertical spacer section and having a first hole and supporting said second tray with said third foot in said right front corner of said second tray extending through said first hole in said forward support ledge, and a rear support ledge attached normal to said vertical spacer section and having a second hole and supporting said second tray with said fourth foot in said right corner of said second tray extending through said second hole in said forward support ledge; and (e) wherein said plurality of inner bottom tabs and outer bottom tabs attached to said vertical spacer section of said left riser have a interlaced arrangement along the length of said left riser in the following alternating order: outer bottom tab, inner bottom tab, outer bottom tab, inner bottom tab, and outer bottom tab; and (f) wherein said plurality of inner bottom tabs and outer bottom tabs attached to said vertical spacer section of said right riser have a interlaced arrangement along the length of said right riser in the following alternating order: outer bottom tab, inner bottom tab, outer bottom tab, inner bottom tab, and outer bottom tab.

4. The invention defined in claim 3 wherein said left riser includes a single upward extending top tab attached to said vertical spacer section and in detached contact with the outside of the left wall of said second tray.

5. The invention defined in claim 4 wherein said right riser includes a single upward extending top tab attached to said vertical spacer section and in detached contact with the outside of the left wall of said second tray.

6. The invention defined in claim 5 wherein each said outer bottom tab on said left riser includes a horizontal ridge which rests on the top edge of said left wall of said first tray and a downward extending tab which contacts the outside of said left wall of said first tray in a flush manner.

7. The invention defined in claim 6 wherein each said outer bottom tab on said right riser includes a horizontal ridge which rests on the top edge of said right wall of said first tray and a downward extending tab which contacts the outside of said right wall of said first tray in a flush manner.

8. The invention defined in claim 7 wherein each said inner bottom tab on said left riser includes a spacer attached at a right angle to said vertical spacer section and attached to a downward extending tab having an edge that makes contact with the inside left wall of said first tray.

9. The invention defined in claim 8 wherein each said inner bottom tab on said right riser includes a spacer attached at a right angle to said vertical spacer section and attached to a downward extending tab having an edge that makes contact with the inside right wall of said first tray.

10. The invention defined in claim 9 wherein said second tray is staggered with respect to said first tray by sliding said second tray and said right and left risers toward the rear of said first tray.

11. The invention defined in claim 3 wherein each said outer bottom tab on said left riser includes a horizontal ridge which rests on the top edge of said left wall of said first tray and a downward extending tab which contacts the outside of said left wall of said first tray in a flush manner.

12. The invention defined in claim 11 wherein each said outer bottom tab on said right riser includes a horizontal ridge which rests on the top edge of said right wall of said first tray and a downward extending tab which contacts the outside of said right wall of said first tray in a flush manner.

13. The invention defined in claim 12 wherein each said inner bottom tab on said left riser includes a spacer attached at a right angle to said vertical spacer section and attached to a downward extending tab having an edge that makes contact with the inside left wall of said first tray.

14. The invention defined in claim 13 wherein each said inner bottom tab on said right riser includes a spacer attached at a right angle to said vertical spacer section and attached to a downward extending tab having an edge that makes contact with the inside right wall of said first tray.

15. The invention defined in claim 14 wherein said second tray is staggered with respect to said first tray by sliding said second tray and said right and left risers toward the rear of said first tray.

16. The invention defined in claim 15 wherein said left riser includes a single upward extending top tab attached to said vertical spacer section and in detached contact with the outside of the left wall of said second tray.

17. The invention defined in claim 16 wherein said right riser includes a single upward extending top tab attached to said vertical spacer section and in detached contact with the outside of the left wall of said second tray.

* * * * *